United States Patent [19]

Sakai

[11] Patent Number: 4,488,450

[45] Date of Patent: Dec. 18, 1984

[54] DEVICE FOR RELEASABLY SECURING A FINELY ANGULARLY ADJUSTED SHAFT

[75] Inventor: Akira Sakai, Kamifukuoka, Japan

[73] Assignee: Tokyo Kinzoku Kabushikikaisha, Japan

[21] Appl. No.: 467,854

[22] Filed: Feb. 18, 1983

[51] Int. Cl.[3] ..... G05G 7/06

[52] U.S. Cl. ..... 74/531; 74/553; 188/74

[58] Field of Search ..... 74/531, 553; 192/79, 192/93 R; 188/74, 75

[56] References Cited

U.S. PATENT DOCUMENTS

| | | | |
|---|---|---|---|
| 3,031,035 | 4/1962 | Tomita | 74/531 |
| 3,236,119 | 2/1966 | Popper | 74/531 |
| 3,477,777 | 11/1969 | Grosjean | 74/531 |
| 3,520,211 | 7/1970 | Mowery | 74/531 |
| 3,916,721 | 11/1975 | Egger | 188/74 |
| 4,184,572 | 1/1980 | Poubear | 192/79 |
| 4,442,724 | 4/1984 | Nirasawa et al. | 74/531 |

*Primary Examiner*—Alexander Grosz
*Assistant Examiner*—Michael F. Trettel
*Attorney, Agent, or Firm*—Eric P. Schellin

[57] ABSTRACT

The device for releasably securing stationarily a finely angularly adjusted shaft in an instrument with respect to the body thereof includes a cylindrical flange formed in the body and rotatably supporting the shaft therein and provided with a plurality of cut-out portions arranged circumferentially spaced from each other, a rotatable clamping ring rotatably fitted around the flange and having in its periphery wedge-shaped recesses the arrangement of which corresponds to that of the cut-out portions, and clamping members each received in the respective cut-out portion and wedge-shaped recess aligned therewith so that each clamping member is interposed between the outer surface of the shaft and the respective recess, thereby permitting the shaft to be releasably secured stationarily with respect to the body by rotating the clamping ring in one direction in which each clamping member is urged against the shaft by the wedge-shaped recess, while the shaft is released to freely rotate when the clamping ring is rotated in the opposite direction. According to the present invention, the device comprises a pivot pin arranged at the side of the respective cut-out portions preferably at the side opposite to the direction of rotation of the clamping ring for the clamping action of the shaft, and the respective clamping member is formed with a ear portion having an opening formed therein which is pivotally engaged with the respective pivot pin so that the clamping member is positively prevented from being rollingly rotated in the cut-out portion during the rotation of the clamping ring thereby preventing undesired rotation of the shaft which might be caused by the rotation of the clamping members at the moment the shaft is secured stationarily by the clamping members during the rotation of the clamping ring. The clamping members may be formed integrally in a clamping member supporting ring. A rotation preventing ring having at least a stopper recess is provided around the cylindrical flange and the stopper recess is engaged with stopper lug(s) formed in the body so as to stationarily secure the rotation preventing ring with respect to the body. The rotation preventing ring is preferably interposed between the rotatable clamping ring and a C-ring secured to the shaft for preventing the removal of the clamping ring from the shaft. The rotation of the clamping ring is positively prevented from being transmitted to the C-ring by the interposition of the rotation preventing ring thereby preventing rotation of the shaft.

6 Claims, 11 Drawing Figures

DEVICE FOR RELEASABLY SECURING A FINELY ANGULARLY ADJUSTED SHAFT

BACKGROUND OF THE INVENTION

The present invention relates to a device for releasably securing stationarily a finely angularly adjusted shaft in an instrument with respect to the body thereof, and, more particularly, to a device for releasably securing a finely angularly adjusted shaft in an instrument connected to components required to be finely adjusted their operating positions and a coaxial tubular shaft fixedly secured to the above described shaft and connected to indicating means for indicating the adjusted positions of the shaft with respect to the body of the instrument.

The device of the type described above was well known in the art.

Such a well known device comprises a core shaft rotatably supported in a body of the instrument and operatively connected to components such as a movable contact of a potentiometer or a rotatable pole plates of a variable capacitor for turning purpose of a short-wave radio communication system requiring fine adjustment and a coaxial tubular shaft fixedly secured around the core shaft and connected to indicating means, preferably, to digital indicating means for indicating the adjusted position of the shafts. The tubular shaft is journaled in a cylindrical flange extending upwardly from the upper wall of the body of the instrument. The cylindrical flange is formed with a plurality of cut-out portions circumferentially spaced from each other. A rotatable clamping ring is rotatably fitted around the tubular flange and it is formed with the same number of wedge-shaped recesses in the inner periphery thereof as the number of the cut-out portions along the inner periphery thereof circumferentially spaced from each other, the relative positions of the recesses to each other corresponding to the relative positions of the cut-out portions to each other. A clamping member such as a roller is located in each of the recesses and the cut-out portion positioned in alignment therewith. Thus, when the clamping ring is rotated in one direction around the cylindrical flange after the shafts are finely adjusted their angular positions, each of the clamping members is urged radially inwardly by the wedge-shaped recess during the rotation of the clamping ring so that the clamping members are pressed against the tubular shaft so as to stationarily secure the shafts with respect to the body of the instrument, while, when the clamping ring is rotated in the opposite direction, the clamping members are permitted to be released from the tubular shaft so that the shafts can be freely rotated for the readjustment.

In such a device described above, the clamping members are necessarily rotated within the cut-out portions when the clamping ring is rotated in the direction for securing the shafts even though the clearance between the cut-out portion and the clamping member is made to the minimum. Therefore, it can not be avoided that the rotation of the clamping members causes the rotation of the tubular shaft at the moment the same is to be stationarily secured by the rotation of the clamping ring, thereby resulting in fatal disadvantage that the shafts can not be accurately secured at the desired value of the indication given in the indicating means because the shafts are rotated from the finely angularly adjusted positions just at the moment they are secured by the rotation of the clamping ring causing the rotation of the clamping members.

SUMMARY OF THE INVENTION

It is an object of the present invention to provide a novel and useful device for releasably securing stationarily a finely angularly adjusted shaft in an instrument with respect to the body thereof which positively avoids the disadvantages of the prior art device as described above.

Another object is to provide a device of the type as described in connection with the prior art device, wherein the rotation of the clamping members are positively prevented at the moment of securing stationarily the shafts during the rotation of the clamping members so that securing of the shafts at the desired adjusted position is insured.

The above objects are achieved by providing a device for releasably securing stationarily a finely angularly adjusted shaft in an instrument with respect to the body thereof including a cylindrical flange formed in the body and rotatably supporting the shaft therein, the flange having a plurality of cut-out portions arranged circumferentially spaced apart from each other, a rotatable clamping ring rotatably fitted around the flange and having in its inner periphery the same number of wedge-shaped recesses as that of the cut-out portions, the relative circumferential positions of the recesses to each other corresponding to the relative circumferential positions of the cut-out portions to each other, and clamping members each received in each of the cut-out portions and each of the wedge-shaped recesses around the shaft thereby permitting the shaft to be secured stationarily with respect to the body by rotating the clamping ring in one direction in which the clamping members are pressed against the shaft so as to fixedly secure the same by virtue of the wedge-shaped recesses slidingly engaging with the clamping members during the rotation of the clamping ring, while the shaft is permitted to freely rotate by rotating the clamping ring in the opposite direction, characterized in that a pivot pin is formed in the body adjacent to each of the cut-out portions of the cylindrical flange and each of the clamping members is formed with an ear portion having an opening formed therein, each of the pivot pins being rotatably received in the opening of each of the clamping members thereby preventing each of the clamping members from being rollingly rotated in the cut-out portion to insure the accuracy of stationarily securing the shaft at the finely angularly adjusted position.

Each of the pivot pins is preferably positioned at a position at the side each of the cut-out portions opposite to the direction of rotation of the clamping ring in which the clamping members are pressed against the shaft so that the smooth movement of the clamping members is insured during the rotation of the clamping ring for securing the shaft. It is preferred to provide a clamping member supporting ring arranged around the cylindrical flange, and to integrally form the clamping members in the clamping member supporting ring. This renders the production and assembly of the device to be more convenient and efficient.

In the present invention, it is preferred to provide at least a rotation preventing ring arranged around the cylindrical flange adjacent to the clamping ring and having at least a stopper recess formed therein, and at least a stopper lug formed in the body, the stopper recess engaging with the stopper lug thereby preventing the rotation of the clamping ring from being transmitted to the shaft for insuring the accuracy of stationarily securing the shaft at the finely angularly adjusted position.

In this case it is preferred to interpose the rotation preventing ring between the clamping ring and a C-ring secured to the shaft for preventing the removal of the clamping ring from the shaft.

In the actual application of the present invention, the finely angularly adjusted shaft may comprise as previously described a core shaft operably coupled with component such as a movable contact in a potentiometer or rotatable pole plates in a variable capacitor for turning purpose of a short wave radio communication system to be finely adjusted for setting a required characteristics of the instrument and a tubular shaft secured around the core shaft and connected to indicating means for indicating the adjusted position.

DETAILED DESCRIPTION OF THE PREFERRED EMBODIMENTS

Figure 1:
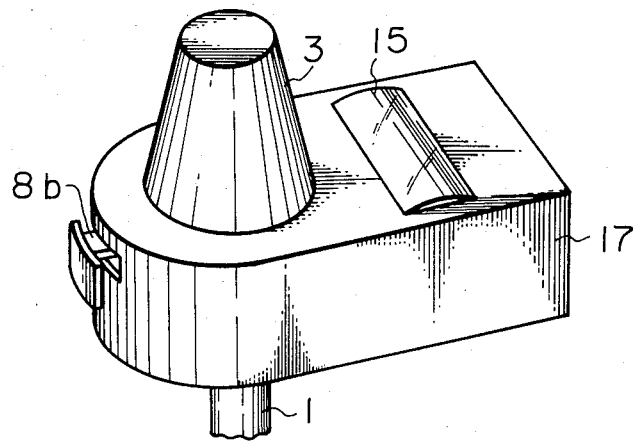
Fig. 1 PRIOR ART
FIG. 1 is a perspective general view showing an example of an instrument in which the prior art device for releasably securing stationarily a finely angularly adjusted shaft of the instrument with respect to the body thereof is incorporated.

Prior to the description of the present invention, an example of the prior art device of releasably securing the shaft stationarily with respect to the body of an instrument will be described with reference to FIGS. 1–4 for the better understanding of the present invention.

The instrument shown in FIGS. 1–4 comprises a rotatable core shaft 1 operably connected to components of the instrument such as a movable contact in a potentiometer or rotatable pole plates in a variable capacitor for the turning purpose of a short wave radio communication system requiring a fine angular adjustment and a tubular shaft 2 having a worm wheel 2*a* integrally formed or fixedly secured thereto and fixedly secured around the shaft 1 by means of a set screw 4 which is threaded into the tubular shaft 2 against the shaft 1 through a manually manipulatable knob 3 fitted around the upper end of the tubular shaft 2, the worm wheel 2*a* meshing with a worm 11 which is integral with a gear 12 so as to be rotated therewith. The gear 12 meshes with a gear 13 of a digital indicating means comprising a plurality of coaxial digit indicating wheels 14 carrying on their periphery series of digits, the digit indicating wheels 14 being operatively connected by a figure shifting gear 16 so that the adjusted angular positions of the shafts 1,2 can be digitally indicated by the wheels 14 through a lens 15. The indicating means is housed in a body 17 of the instrument and the lens 15 is secured to the upper wall of the body 17. The worm 11 is manually or mechanically rotated through a shaft 11*a* fixedly mounting the worm 11 thereon and projecting outwardly from the body 17 in order to adjust the angular positions of the shafts 1,2 through the worm 11 and the worm wheel 2*a* and to indicate the adjusted value by the indicating means.

Figure 2:
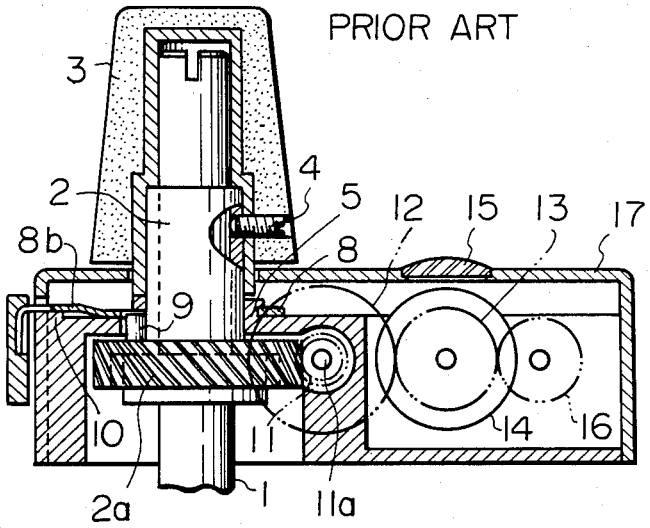
Fig. 2 PRIOR ART
FIG. 2 is a vertical cross-sectional view of FIG. 1.
Figure 3:
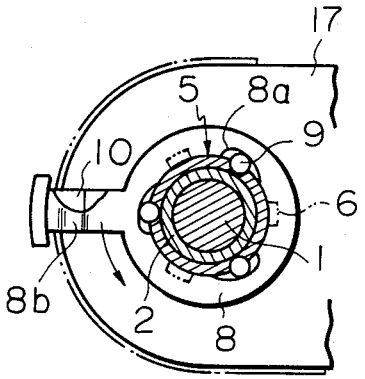
Fig. 3 PRIOR ART
FIG. 3 is a fragmentary plan view partly in section showing the arrangement of the clamping ring and the clamping members with respect to the cylindrical flange of the body and the tubular shaft shown in FIG. 2.
Figure 4:
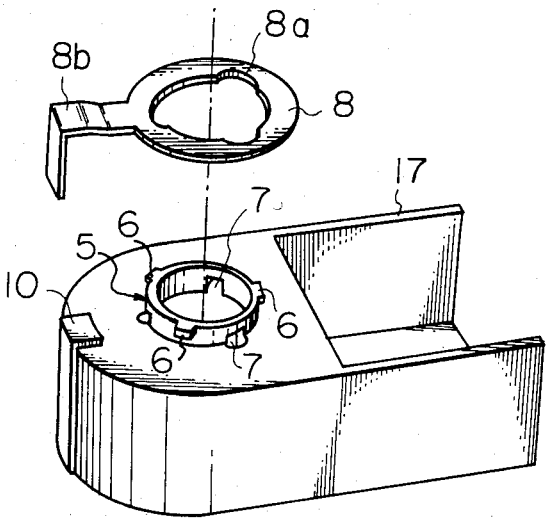
Fig. 4 PRIOR ART
FIG. 4 is an exploded perspective view with same portions omitted showing the details of the cylindrical flange and the clamping ring shown in FIG. 3.

The body 17 is provided with a cylindrical flange 5 as shown in FIGS. 2–4 and the tubular shaft 2 is rotatably journaled in the flange 5, the upper end of the shafts 1, 2 projecting from the body 17 to which the knob 3 is secured. The upper end of the cylindrical flange 5 is provided with a plurality of radially outwardly projecting ears 6 (three ears 6 shown in the figures) circumferentially spaced apart from each other, preferably circumferentially equally spaced from each other, and the same number of cut-out portions 7 as the number of the ears 6 are formed at the lower end of the flange 5 circumferentially spaced from each other, the relative angular positions of the cut-out portions 7 corresponding to the relative angular positions of the ears 6 but the angular phase of the cut-out portions 7 being offset from the angular phase of the ears 6 as shown. The cut-out portions 7 are extended through the wall of the body 17 so that clamping members 9 in the form of rollers to be described later can be received in the respective cut-out portions 7 from the lower side of the body 17.

A rotatable clamping ring 8 having a manually manipulatable knob 8*b* is provided in its inner periphery having an inner diameter corresponding to the outer diameter of the cylindrical flange 5 with the same number of wedge-shaped or following-wave-shaped recesses 8*a* as the number of the ears 6 and the cut-out portions 7 circumferentially spaced apart from each other, the relative angular positions of which are set so as to correspond to the relative angular positions of the ears 6 as well as the cut-out portions 7. Thus, the clamping ring 8 can be rotatably fitted around the cylindrical flange 5 with the recesses 8*a* being aligned with the ears 6 so as to allow the ears 6 to pass through the recesses 8*a*.

The clamping members 9 described previously are located in the respective cut-out portions 7 after the recesses 8*a* are aligned with the respective cut-out portions 7 and are held on the worm wheel 2*a* so that the respective clamping members 9 are interposed between the tubular shaft 2 and the recesses 7 as shown in FIG. 3, the clamping ring 8 being prevented from being removed in this position of the ring 8.

Therefore, when the clamping ring 8 is rotated in the counterclockwise direction as indicated by the arrow in FIG. 3, the wedge-shaped recesses 8a urges the respective clamping members 9 inwardly so as to be pressed against the tubular shaft 2 so that the shafts 1, 2 are secured stationarily with respect to the body 17. In this position, the knob 8b is moved upwardly and held stationarily on a pillow member 10 so as to prevent the ring 8 from being rotated in the clockwise direction and prevent the shafts 1,2 from being released from the clamping members 9. When the clamping ring 8 is rotated in the clockwise direction, the clamping members 9 are released from the recesses 8a and the shafts 1, 2 are allowed to freely rotate.

As described previously, such a device as just described above has the fatal disadvantage that the clamping members 9 are unavoidably rotated at the very moment the same are pressed against the tubular shaft 2 so as to stationarily secure the shafts 1, 2 by the sliding engagement of the recesses 8a with the clamping members 9 during the rotation of the clamping ring 8 thereby resulting in the rotation even though in a small amount of the shafts 1, 2 and making it impossible to accurately secure the shafts 1, 2 at the desired adjusted angular positions of the shafts 1, 2, while the indicating means unavoidably indicates an erroneous value deviating from the desired value.

Now, the device of the present invention which positively avoids the above described disadvantage of the prior art device will be described below with reference to FIGS. 5–11.

Figure 5:
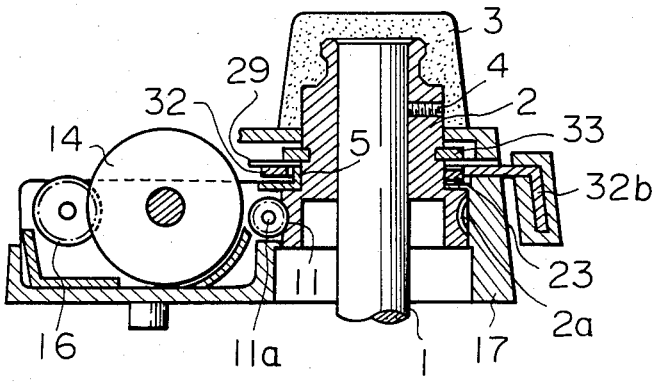
FIG. 5 is a vertical cross-sectional view similar to FIG. 1 but showing the details of the device of the present invention.

The instrument shown in FIG. 5 is substantially similar to that shown in FIGS. 1 and 2 except the facts described below and operates in the similar manner as described in connection with FIGS. 1 and 2, and, therefore, like parts of the device of FIG. 5 bear the same reference numerals as those of the device of FIGS. 1–4 for the simplicity of the description.

Figure 6:
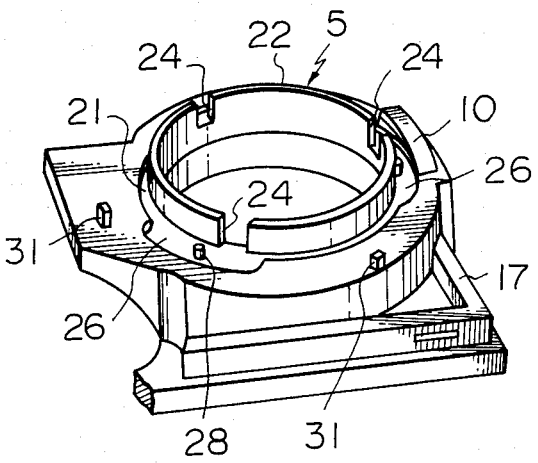
FIG. 6 is a fragmentary perspective view showing the detailed construction of the cylindrical flange formed in the body of the instrument shown in FIG. 5.
Figure 7:
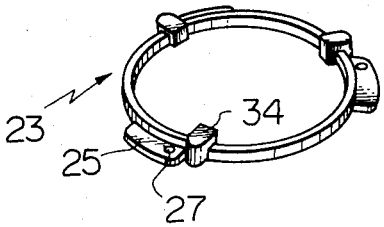
FIG. 7 is a perspective view showing the clamping member supporting ring of the present invention in which the clamping members are integrally formed.

The cylindrical flange 5 of the present invention shown in FIG. 6 has at its upper end 22 a plurality of cut-out portions 24 (three cut-out portions 24 shown in FIG. 6) circumferentially spaced apart from each other, preferably equally spaced from each other.

A circular shallow groove 21 is formed in the upper surface of the body 17 around the lower end of the cylindrical flange 5 and a shallow recessed portion 26 having the same depth as the groove 21 is formed in the upper surface of the body 17 adjacent to the respective cut-out portion 24 and is joined with the groove 21 as shown, the lower end each of the cut-out portions 24 being flush with the bottom surface of the respective recessed portion 26. A pivot pin 28 is provided in the respective recessed portion 26 extending upwardly from the bottom surface thereof at a position preferably at the side of the respective cut-out portion 24 opposite to the direction of rotation of a clamping ring 32 to be desdribed later similar in construction and operation to the clamping ring 8 described previously, in which direction clamiping members 34 to be described later are pressed against the tubular shaft 2 by the rotation of the clamping ring 32 in like manner as described previously.

Each of the clamping members 34 has the width corresponding to the width of the respective cut-out portion 24 and in accordance with the characteristic feature of the present invention, each of the clamping members 34 is integrally formed in a clamping member supporting ring 23 having the size snugly engageable in the groove 21 as shown, the relative angular positions of the clamping members 34 to each other is set so as to correspond to the relative angular positions of the cut-out portions 24 so that the clamping members 34 are snugly received in the respective cut-out portions 24 when the clamping member supporting ring 23 is fitted in the groove 21. The clamping member supporting ring 23 is formed integrally with the same number of outwardly extending ear portions 25 each having an opening 27 as the number of the recessed portions 26 at positions so as to be snugly received in the respective recessed portions 26 with each pivot pin 28 engaging with the opening 27 in the respective ear portion 25 when the ring 23 is fitted in the groove 21. The outer end of each clamping member 34 is rounded to form substantially a semicircular shape and projects outwardly a suitable amount from the outer surface of the ring 23 while the inner end is in such a concave form just fitting with the outer surface of the tubular shaft 2 when engaged therewith and projects inwardly by an amount greater than the thickness of the cylindrical flange 5 so that the inner end of each clamping member 34 can be positively pressed against the outer surface of the tubular shaft 2 when the clamping member 34 is urged inwardly by the action of the clamping ring 32. The clamping member supporting ring 23 is preferably molded integrally with the clamping members 34 and the ear portions 25 by a suitable plastic material, but it may be formed of a metal.

Figure 8:
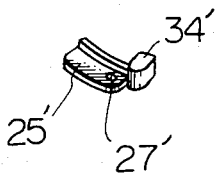
FIG. 8 is a perspective view showing an alternative form of the clamping member of the present invention.

FIG. 8 shows an alternative form of the clamping member 34' integrally formed with the ear portion 25' having the opening 27'. The clamping member 34' can be rereceived in the respective cut-out portion 24 with the ear portion 25' being received in the respective recessed portion 26 and the opening 27' engaging with the respective pivot pin 28. In this case, the circular groove 21 may be dispensed with.

Figure 9:
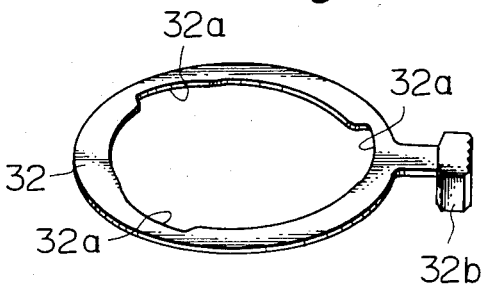
FIG. 9 is a perspective view showing the clamping ring of the present invention.
Figure 10:
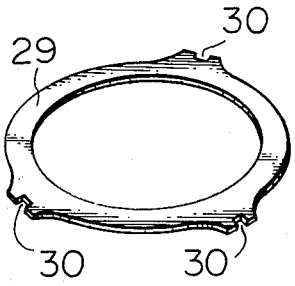
FIG. 10 is a perspective view showing the rotation preventing ring of the present invention.

The clamping ring 32 has in its inner periphery the same number of wedge-shaped recesses 32a as the number of the cut-out portions 24 as shown in FIG. 9, the relative angular positions of the recesses 32a to each other corresponding to those of the cut-out portions 24, as well as a manually operable knob 32b. The construction and the operation of the clamping ring 32 are the same as those of the clamping ring 8 previously described.

In accordance with another characteristic feature of the present invention, a rotation preventing ring 29 is provided in order to positively prevent the undesirable rotation of the shafts 1, 2 when they are to be stationarily secured by the operation of the clamping ring 32. The rotation preventing ring 29 is fitted around the cylindrical flange 5 preferably above the clamping ring 32 and beneath a C-ring 33 secured to the tubular shaft 2 for preventing the removal of the clamping ring 29 from the shaft 2, and is formed with at least a stopper recess 30 (three recesses 30 shown in FIG. 9) in the outer periphery, which engages with a stopper lug 31 formed in the upper surface of the body 17 as shown in FIG. 6, so that the ring 29 is held stationarily. Thus, the rotation of the clamping ring 32 is positively prevented from being transmitted to the C-ring secured to the tubular shaft 2 thereby permitting the shafts 1, 2 to be positively held stationarily during the rotation of the clamping ring 32.

The operation of the device of the present invention described above will be described below with reference to FIG. 11.

Figure 11:
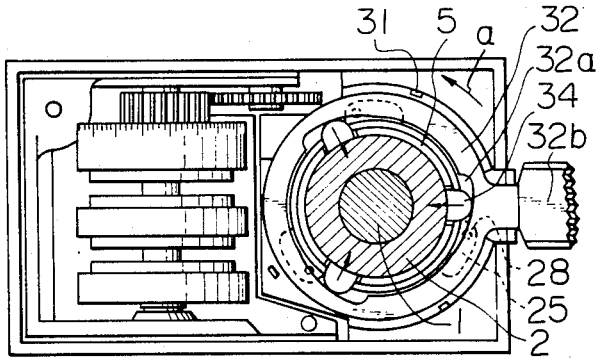
FIG. 11 is a plan view with the upper wall of the body being broken and the shafts in section showing the operation of the clamping ring and the clamping members of the present invention.

When it is desired to secure the shafts 1, 2 stationarily with respect to the body 17 of the instrument after the shafts 1, 2 have been finely angularly adjusted to the desired angular position by rotating the shaft 11*a* with the clamping ring 32 being held in its released or clockwise rotated position (FIG. 11), the clamping ring 32 is rotated in the counterclockwise direction as indicated by the arrow in FIG. 11. Then, each of the clamping members 34 is urged inwardly by the respective wedge-shaped recess 32*a* slidingly contacting with the outer end of the clamping member 34, wherein each of the clamping members 34 is very slightly swung about the pivot pin 28 but each clamping member 34 is positively prevented from rollingly rotating in the cut-out portion 24 occurring in the case of the prior art device previously described by virtue of the provision of the pivot pins 28 pivotably supporting the respective clamping members 34, thereby resulting in substantially radially inwardly directed movement of the respective clamping members 34. Therefore, the concave shaped inner end each of the clamping members 34 is firmly and snugly compressed against the outer surface of the tubular shaft 2 to secure the shafts 1, 2 stationarily with respect to the body 17 without causing any undesirable rotation of the shafts 1, 2 during the rotation of the clamping ring 32. Thus, the shafts 1, 2 are held stationarily just at the angular positions desired to be set. In this connection, the location of each pivot pin 28 at the side of the respective cut-out portion 24 opposite to the direction of rotation of the clamping ring 32 serves to insure smooth and accurate action of each clamping member 34.

The pillow member 10 serves to maintain the clamping ring 32 at the clamping position thereof.

It is clear that the clamping members 34' shown in FIG. 8 operate in the similar manner as the clamping members 34.

During the rotation of the clamping ring 32, the transmission of the rotational movement of the clamping ring 32 to the C-ring 33 secured to the tubular shaft 2 is positively prevented by virtue of the provision of the rotation preventing ring 33 interposed between the clamping ring 32 and the C-ring 33, so that the shafts 1, 2 are positively held stationarily.

What is claimed is:

1. In a device for releasably securing stationarily a finely angularly adjusted shaft in an instrument with respect to the body thereof including a cylindrical flange formed in said body and rotatably supporting said shaft therein, said flange having a plurality of cut-out portions arranged circumferentially spaced apart from each other, a rotatable clamping ring rotatably fitted around said flange and having in its inner periphery the same number of wedge-shaped recesses as that of said cut-out portions, the relative circumferential positions of said recesses to each other corresponding to the relative circumferential positions of said cut-out portions to each other, and a clamping member each received in each said cut-out portion and each said wedge-shaped recess around said shaft thereby permitting said shaft to be secured stationarily with respect to said body by rotating said clamping ring in one direction in which said clamping members are pressed against said shaft so as to fixedly secure the same by virtue of said wedge-shaped recesses slidingly engaging with said clamping members during the rotation of said clamping ring, while said shaft is permitted to freely rotate by rotating said clamping ring in the opposite direction, the improvement wherein a pivot pin is formed in said body adjacent to each said cut-out portion of said cylindrical flange and each of said clamping members is formed with an ear portion having an opening formed therein, each said pivot pin being rotatably received in said opening of each said clamping member thereby preventing each said clamping member from being rollingly rotated in said cut-out portion to insure the accuracy of stationarily securing said shaft at said finely angularly adjusted position.

2. Device as set forth in claim 1, wherein each of said pivot pins is positioned at a position at the side each of said cut-out portions opposite to said one direction of rotation of said clamping ring in which said clamping members are pressed against said shaft.

3. Device as set forth in claim 1, comprising a clamping member supporting ring arranged around said cylindrical flange, said clamping members being integrally formed in said clamping member supporting ring.

4. Device as set forth in claim 1, further comprising at least a rotation preventing ring arranged around said cylindrical flange adjacent to said clamping ring and having at least a stopper recess formed therein, and at least a stopper lug formed in said body, said stopper recess engaging with said stopper lug thereby preventing the rotation of said clamping ring from being transmitted to said shaft for insuring the accuracy of stationarily securing said shaft at the finely angularly adjusted position.

5. Device as set forth in claim 4, wherein said rotation preventing ring is interposed between said clamping ring and a C-ring secured to said shaft for preventing the removal of said clamping ring from said shaft.

6. Device as set forth in claim 1, wherein said finely angularly adjusted shaft comprises a core shaft operably coupled with components to be finely adjusted for setting a required characteristics of said instrument and a tubular shaft secured around said core shaft and connected to indicating means for indicating the adjusted position.

* * * * *